United States Patent [19]

Sunaga et al.

[11] Patent Number: 4,606,212

[45] Date of Patent: Aug. 19, 1986

[54] DEVICE FOR COLD DRAWING SEAMLESS METAL TUBES HAVING UPSET PORTIONS ON BOTH ENDS

[75] Inventors: Yutaka Sunaga, Kawasaki; Toshio Sakurai, Yokohama, both of Japan

[73] Assignee: Sanwa Kokan Co., Ltd., Yokohama, Japan

[21] Appl. No.: 599,825

[22] Filed: Apr. 13, 1984

[51] Int. Cl.[4] ..... B21C 1/24

[52] U.S. Cl. ..... 72/283; 72/276; 72/285

[58] Field of Search ..... 72/283, 285, 291, 260, 72/265, 276

[56] References Cited

U.S. PATENT DOCUMENTS

| | | | |
|---|---|---|---|
| 565,726 | 8/1896 | De Los Rice | 72/276 |
| 3,290,916 | 12/1966 | Louis et al. | 72/285 |

FOREIGN PATENT DOCUMENTS

| | | | |
|---|---|---|---|
| 2448283 | 6/1975 | Fed. Rep. of Germany | 72/283 |
| 716815 | 12/1931 | France | 72/283 |
| 31426 | 2/1982 | Japan | 72/283 |
| 99429 | 10/1961 | Netherlands | 72/283 |
| 595782 | 12/1947 | United Kingdom | 72/283 |
| 595781 | 12/1947 | United Kingdom | 72/283 |

*Primary Examiner*—Daniel C. Crane

*Attorney, Agent, or Firm*—Wenderoth, Lind & Ponack

[57] ABSTRACT

A draw bench for cold drawing seamless middle tubes having upset portions on both ends. The draw bench includes a die control device, a plug control device including a plug having large and small diameter bearing portions and a draw unit. The die control device and the plug control device and the plug control device are moveable with respect to each other for changing the cross-sectional reducing area between the reducing die and the plug.

9 Claims, 18 Drawing Figures

DEVICE FOR COLD DRAWING SEAMLESS METAL TUBES HAVING UPSET PORTIONS ON BOTH ENDS

BACKGROUND OF THE INVENTION

1. Field of the Invention

The present invention relates to methods of and devices for cold drawing seamless metal tubes, and more particularly to methods of producing the seamless metal tubes by cold drawing and to draw benches for effecting the methods, the seamless metal tubes each having an upset portion on both ends.

These seamless metal tubes are preferably used for drilling tubes, casings, inner rods and outer rods for geological, mineralogical, metallurgical or geothermal research and/or drilling for civil engineering or water wells.

2. Prior Art

While reference to FIGS. 1(*a*)–4(*b*) showing the seamless metal tubes which have been produced by the conventional step and the conventional draw bench, a hot forged thin wall midbody 7*c* of a metal tube is welded at each end with a thick wall end tube 7*b* in order to obtain a larger diameter seamless metal tube or pipe 7 having an upset portion 7*b* on both ends.

Otherwise, the seamless metal tube is produced by casting or lathing, but metallic filaments in such a seamless metal tube are axially cut at welded or lathed portions or at blowholes, which are likely to cause cracks in the seamless metal tube after heat treatment at high temperature.

To this end, a draw bench for drawing the seamless metal tube has been proposed. For example, a small diameter and thin wall seamless metal tube having a diameter of 25–35 mm and a wall thickness of 2.1–3.2 mm such as for a bicycle framework is cold drawn through the draw bench shown in FIGS. 2(*a*)–4(*b*).

The conventional draw bench, which is shown in FIGS. 2(*a*) and 2(*b*), for drawing such seamless metal tubes comprises a bed 12 to be fixed on the floor, a die holder 26 which is mounted at a middle portion on the bed 12 and a closed periphery reducing die 2 which is concentrically mounted in the die holder 26. A pair of tongs 6 and a bearing are arranged on the entry side of the bed 12 for horizontally supporting a plug fixing rod 88.

Secured to a front portion of the rod 88 is a plug 4 which is inserted into the reducing die 2 when drawing.

A draw unit 110 is arranged on the exit side of the bed 12 and comprises a carriage 112 mounted on rollers travelling on the bed 12, the carriage 112 carrying a hook 118 and a chuck 114 for gripping the front tip 7*a* of the mother tube or workpiece 7. The carriage 112 is driven by an endless chain 120 encompassing a driven sprocket wheel (not shown) mounted in the bed 12. The driving sprocket wheel is coupled by any known means with an electric motor (not shown). The hook 118 is engaged with the endless chain 120 when drawing. The front tip 7*a* of the mother tube 7 engaged by jaws 116 of the chuck 114 is strongly pulled by the carriage 112 to draw the tube 7 having an upset portion 7*b* on both ends.

FIGS. 3(*a*) and 3(*b*) show the conventional manner of drawing the seamless metal tubes which have the same outer diameter but unequal inner diameter upset portions on both ends. In FIG. 3(*a*), the plug 4 is held adjacent to a tapered entry in the axial bore of the reducing die 2 with a clearance to the inner periphery of the mother tube 7 to draw the portion of the tube 7 having the small inner diameter upset portion 7*b* on both ends, while the plug 4 in FIG. 3(*b*) is held right in the bore of the reducing die 2 to draw the portion of the tube 7 having a large inner diameter.

FIGS. 4(*a*) and 4(*b*) show another conventional drawing method. The reducing die 2 has an internal surface including an inlet portion 2*b* which tapers forwardly toward the bearing or throat portion 2*a* and an oppositely inclined outlet portion 2*c*. When the enlarged front portion 4*a* of the plug 4 is held right in the bearing portion 2*a* of the reducing die 2, the mother tube 7 is drawn through the bearing portion 2*a* and over the enlarged front portion 4*a* into a drawn tube having a small outer diameter.

In FIG. 4(*b*), the enlarged front portion 4*a* of the plug 4 is passed leftwards across the bearing portion 2*a* and located adjacent to the outlet portion 2*c*. Then the mother tube 7 is drawn through the bearing portion 2*a* and around the small diameter portion 4*b* of the plug 4 to reduce the outer diameter of the drawn tube.

The mother tube 7 is further advanced into the front region where the inner diameter of the mother tube 7 is widened by the enlarged front portion 4*a* of the plug 4 in order to draw the tube 7 having the same inner diameter as that of the enlarged front portion 2*a* of the plug 4 and also having an outer diameter upset portion 7*b* larger than that of the drawn tube 7 produced through the reducing die 2 shown in FIG. 4(*a*).

The seamless metal tube 7 drawn through the conventional reducing die 2 has the following disadvantages.

(1) The seamless mother tube 7 having a small inner diameter is drawn under reduction through the reducing die 2 shown in FIG. 3(*a*) without any internal radial pressure, thus resulting in corrugation in and around the drawn tube.

(2) In FIG. 4(*b*), the mother tube 7 is drawn through the reducing die 2 with the plug 4 held in the bearing portion 2*a* and in the tube 7 to obtain the drawn tube 7 having one outer diameter but two different inner diameter upset portions 7*b*. The tube drawn through the bearing portion 2*a* and over and around the small diameter portion 4*b* of the plug 4 is widened by the enlarged front portion 4*a* of the plug 4 to obtain the drawn tube shown in FIGS. 7(*a*), 7(*b*) and 7(*c*), wherein $d_4$ denotes a large diameter bearing portion of the plug 4, $d_2$ denotes a bearing portion diameter of the reducing die 2, $d_1$ denotes a large diameter of the drawn tube 7, and $d_3$ a small diameter bearing portion of the plug 4 respectively.

Accordingly, $d_4$ becomes an inner diameter of the drawn tube 7 and $d_2$ becomes a small outer diameter of the drawn tube 7, but the large diameter $d_1$ of the drawn tube 7 does not directly connect the bearing portion diameters of the reducing die 2 and the plug 4, but it gives the following functional formula, $$d_1 = f(d_2, d_3, d_4).$$

But we cannot determine the values for $d_1$, $d_2$ and $d_4$ independently. In order to fix the most preferable values for $d_1$, $d_2$ and $d_4$, it is necessary to select the value sufficiently near the most suitable value among the various solutions of the functional formula of $d_1 = f(d_2, d_3, d_4)$.

We cannot, however, obtain the most suitable values for the diameters of $d_1$, $d_2$ and $d_4$.

(3) The configuration of the drawn tube is limited to only two kinds, i.e.
  (a) one having one outer diameter but two unequal inner diameters;
  (b) another having one inner diameter but two unequal outer diameters.

(4) The drawing force of the plug 4 is so small that the plug 4 may be driven to transfer by a hydraulic cylinder, while it needs to provide a balancing unit or a plurality of hydraulic cylinders to balance the reaction upon the strong drawing force of the plug 4, thus making the device complicated and expensive.

SUMMARY AND OBJECTS OF THE INVENTION

A principal object of this invention is to provide a novel and improved method of cold drawing seamless metal tubes which have an upset portion on both ends.

Another object of this invention is to provide a novel and improved method of cold drawing seamless metal tubes wherein a reducing area between a reducing die and a plug is radially changed to draw a seamless metal tube having an upset portion on each end.

Another object of this invention is to provide a method of cold drawing a seamless metal tube wherein the drawing action is sufficiently reliable and reproducible to insure that each and every mother tube is ready to undergo drawing under reduction for forming unequal diameter upset portions on both ends.

Another object of this invention is to provide a novel and improved draw bench whereby a reducing die and a plug having unequal diameter bearing portions are movable with each other and are fixed at the selected positons in order to draw a seamless metal tube having upset portions on both ends.

Another object of this invention is to provide a draw bench whereby the reducing die and the plug are longitudinally movable to a number of different positions but remain at a standstill once they assume the selected positions to obtain a plurality of reducing areas between the reducing die and the plug.

Another object of this invention is to provide a draw bench for drawing seamless metal tubes each having an upset portion on each end without forging, casting or welding.

Another object of this invention is to provide a draw bench for drawing seamless metal tubes each having an upset portion on each end which has no alteration in the structure, in strength of the upset end portions and the midbody of the drawn tube, but has dimensional stability in all areas thereof.

Another object of this invention is to provide a draw bench for drawing seamless metal tubes each having an upset portion on each end, which has no scales, but has tighter tolerance, thus enabling the tubes to be thread without prior machining.

Another object of this invention is to provide a draw bench for drawing seamless metal tubes each having an upset portion on each end, whereby precise threading can be achieved and threading efficiency can be remarkably improved.

Still another object of this invention is to provide a draw bench which can be driven easily, quietly and smoothly.

BRIEF DESCRIPTION OF DRAWING

The nature of the invention will be clear from the following detailed description of particular embodiments of the proposed method of producing seamless metal tubes by cold drawing and of the draw bench when taken with the accompanying drawings, in which:

FIG. 2(*b*) is an enlarged detailed vertical sectional view of a reducing die, a plug and a mother tube shown in FIG. 2(*a*), particularly showing that the mother tube is being drawn through the reducing die and around the plug;

FIG. 5(*b*) is a greatly enlarged detailed vertical sectional view of the die control device of the draw bench shown in FIG. 5(*a*);

FIG. 5(*c*) is a greatly enlarged detailed vertical sectional view of the hydraulic cylinder which is secured to a rear face of the die holder shown in FIGS. 5(*a*) and 5(*b*);

FIG. 7(*b*) is an enlarged vertical section similar to FIG. 7(*a*), with the large diameter bearing of the plug located at the small diameter bearing portion of the reducing die;

FIG. 7(*c*) is also an enlarged vertical section similar to FIG. 7(*a*), with the large diameter bearing of the plug located at the forwardly tapered outlet portion;

FIG. 8(*b*) is a similar cross section of a seamless metal tube drawn through the present draw bench, and having an inner upset portion on one end and outer upset portion on another end;

FIG. 8(*c*) is a similar cross section of a seamless metal tube drawn through the present draw bench, and having an outer upset portion on each end.

DETAILED DESCRIPTION OF THE PREFERRED EMBODIMENT

The method of this invention is characterized in that the cross-sectional reducing area between the reducing die and the plug is preferably changed in accordance with the desired forms of a mother tube to be drawn by longitudinally transferring the reducing die and the plug and fixing them at the selected positions.

Figure 1:
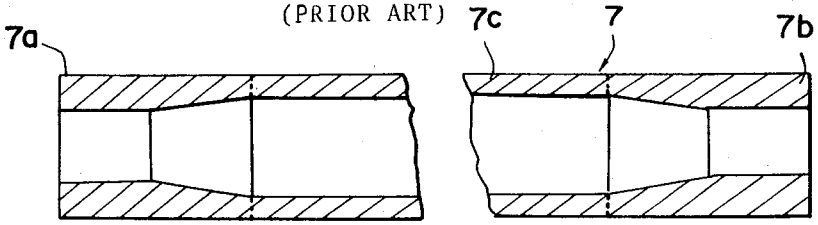
FIG. 1 (PRIOR ART)
FIG. 1 is a cross section of a seamless metal tube made by a conventional process such as by casting, lathing or hot forging, with its midbody partially cut away.
Figure 2:
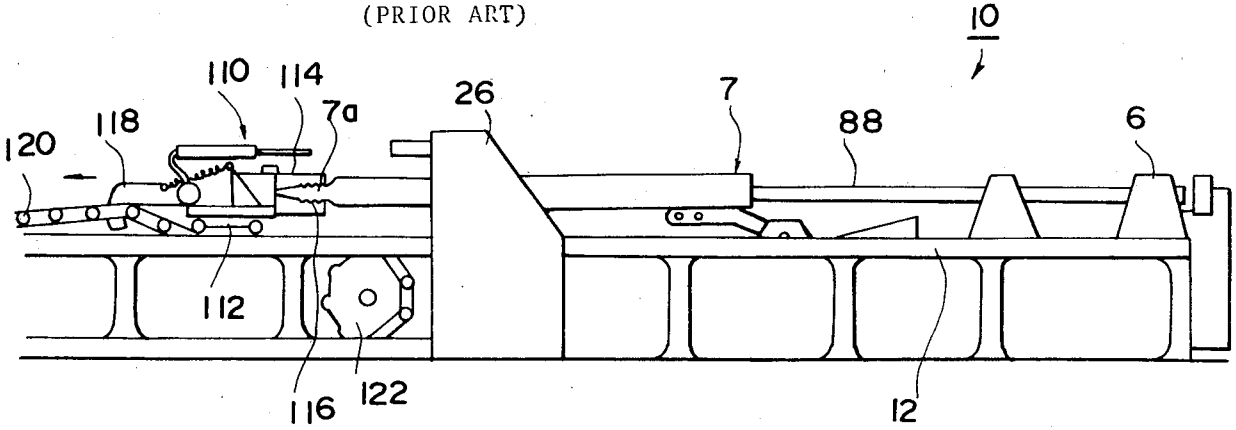
FIG. 2 (a) (PRIOR ART)
FIG. 2(*a*) is a side elevation of a conventional draw bench, with its chain drive portion of a draw unit partially cut away.
Figure 2:
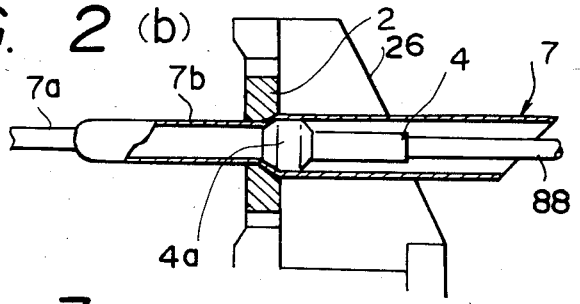
FIG. 2 (b) (PRIOR ART)
Figure 3:
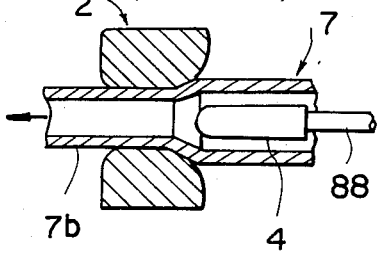
FIG. 3 (a) (PRIOR ART)
FIGS. 3(*a*) and 3(*b*) are fragmentary axial sectional views of a reducing die and modified plug, showing conventional drawing steps for forming seamless metal tubes.
Figure 3:
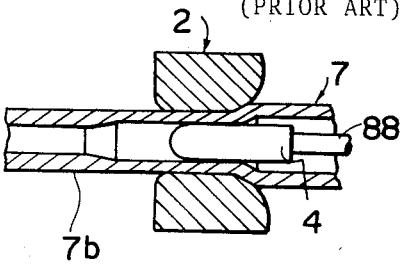
FIG. 3 (b) (PRIOR ART)
Figure 4:
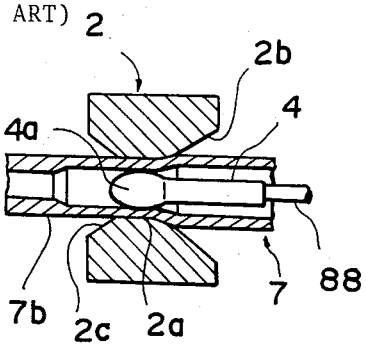
FIG. 4 (a) (PRIOR ART)
FIGS. 4(*a*) and 4(*b*) are similar fragmentary axial sectional views of a modified reducing die and modified plug, showing conventional drawing steps for forming ordinary seamless metal tubes.
Figure 4:
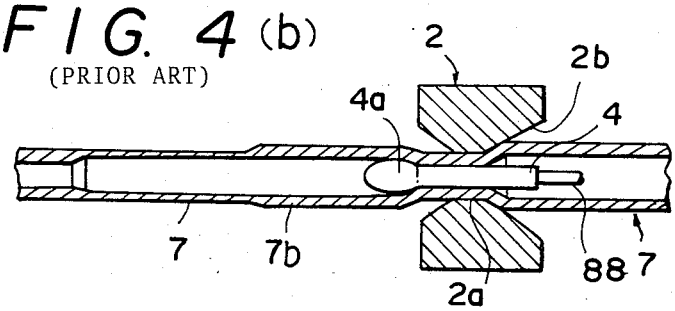
FIG. 4 (b) (PRIOR ART)
Figure 5:
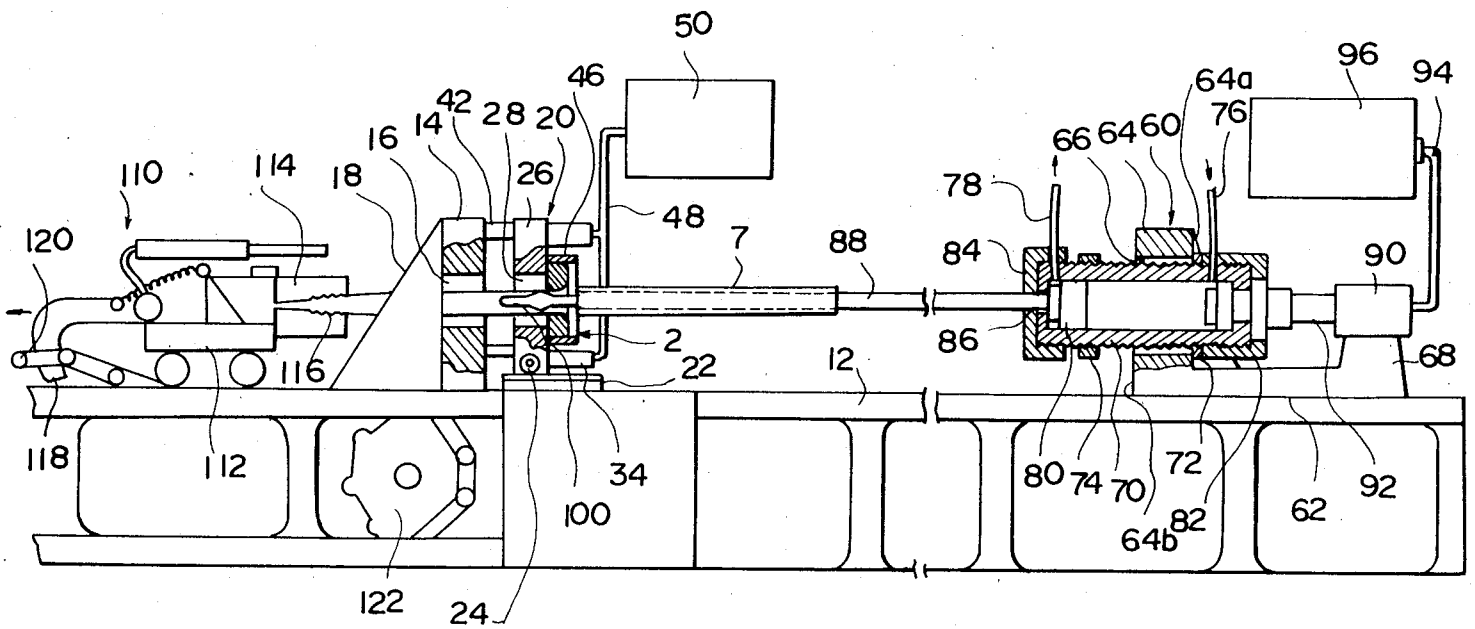
FIG. 5(*a*) is a side elevation, partly in section, of the draw bench which embodies one form of the present invention.
Figure 5:
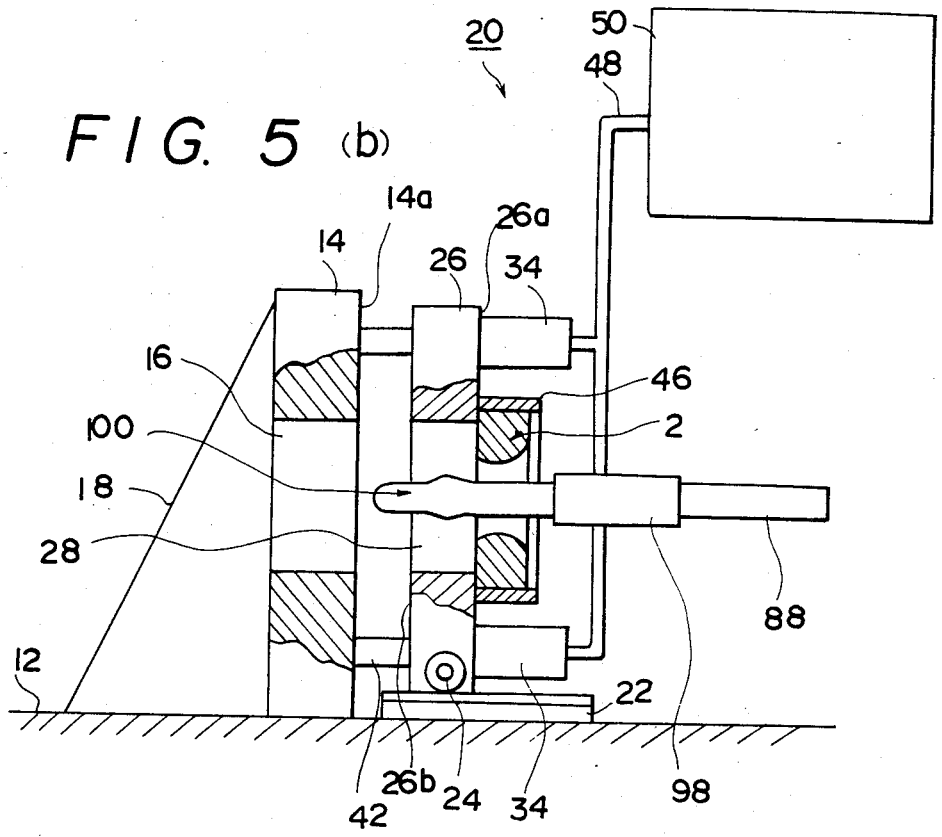
Figure 5:
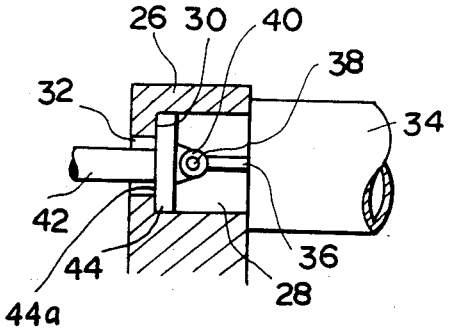

Proceeding now with a detailed description of the drawings, we turn first to FIGS. 5(*a*) through 6 illustrating this invention. The draw bench 10 in accordance with this invention comprises a bed 12 which is usually fixed on the floor, a front stopper 14 which is mounted at the middle portion on the bed 12 and is reinforced by a reinforcing member 18, the stopper 14 having a central large opening 16.

In FIGS. 5(*a*) and 5(*b*), the die control device 20, which is arranged on the bed 12 and adjacent to the front stopper 14, includes a rail 22 mounted longitudinally on the bed 12, and a carriage 24 arranged on the rail 22 transferrably. A die holder 26 which is provided on the carriage 24 and having a central large diameter opening 28 is rigidly provided on the carriage 24, and a cylindrical holder 46 including a closed periphery reducing die 2 is secured to a rear face of the die holder 26 to abut upon the central large diameter opening 28 of the die holder 26.

A pair of hydraulic cylinders 34 are laterally provided at the diametrically peripheral portions on the rear face of the die holder 26, each end portion of the hydraulic cylinders is penetrated through the die holder 26 and connected to the rear face of the front stopper 14 by means of a ram 42.

As particularly shown in FIG. 5(*c*), a pair of cylindrical hollow portions (cavities) 28 are laterally formed into the die holder 26 from its rear face and near its outer periphery, and a small opening 32 is laterally provided through an innermost wall 30 of each cavity 28. A large diameter flange 44 of a ram 42 is inserted into the hollow portion 28, the ram extending through the small opening 32 and being connected to the rear face of the front stopper 14. The front end of the piston 36 of the hydraulic cylinder 34 is coupled to a male lug 40 which is provided at a central rear face of the large diameter flange 44, and the front end of the hydraulic cylinder 34 is secured to the rear face of the die holder 26 to abut upon the hollow portion 28 thereof.

In this way, the front face 44*a* of the large diameter flange 44 provided at the end of the ram 42 is brought into contact with the innermost portion 30 of the cylindrical hollow portion 28 when the piston (not shown) within the hydraulic cylinder 34 is advanced forwardly.

The hydraulic cylinder 34 produces a pushing force which is larger than a tube drawing force of for instance 150–200 tons. In order to fix the die holder 26 at the desired position, the larger diameter flange 44 is preferably brought into contact with the innermost portion 30. The hydraulic cylinders 34 are connected to a hydraulic unit 50 by a pipe 48.

Figure 6:
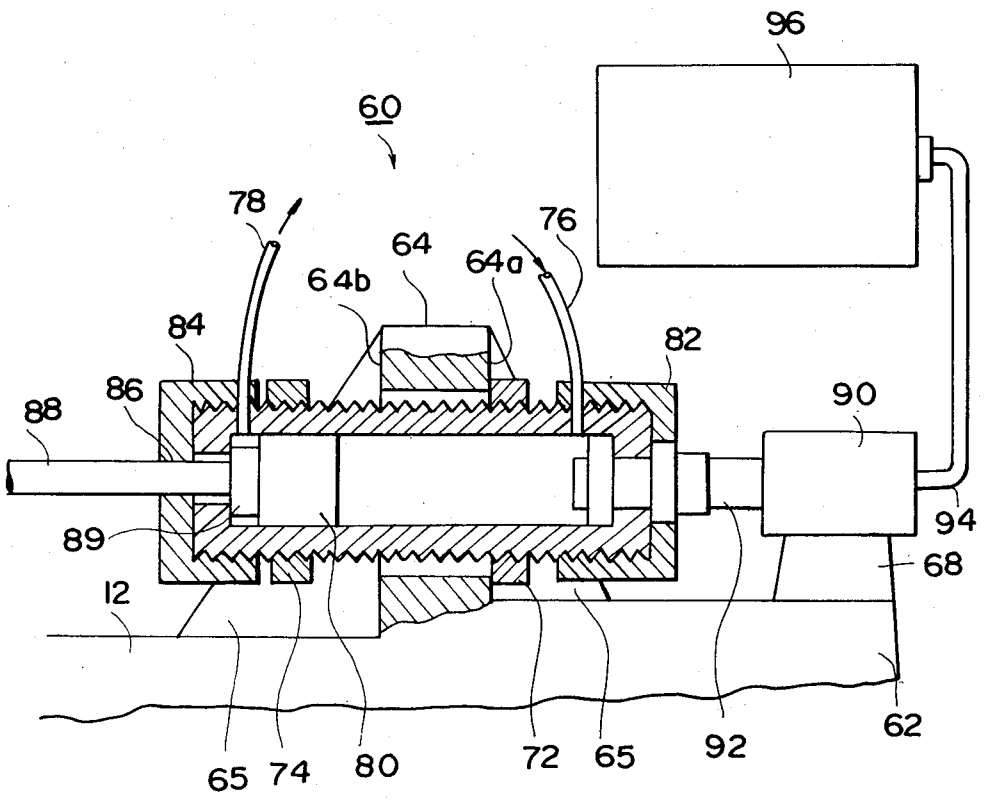
FIG. 6 is a greatly enlarged detailed vertical sectional view of the plug control device.

A plug control device 60 shown in FIG. 6 is arranged on the bed 12 at the entry side thereof and coaxially with the die control device 20. The plug control device 60 includes a base 62 which is rigidly mounted on the bed 12, a rear stopper 64 having a central lateral opening 66, and a rear post 68, the rear stopper 64 being reinforced on both sides by a pair of reinforcing members 65.

A leading screw compressed-air cylinder 70 having a radial small opening 71 through a periphery rotatably and slidably extends through the central lateral opening 66, and a pair of screw nuts 72 and 74 are threadedly screwed on the extending portions of the compressed-air cylinder 70.

A rear end cover 82 including a compressed-air supply flexible pipe 76 is threadedly screwed on the rear end of the cylinder 70, and a front cover 84 having a central opening 86 and a radial small opening 87 is threadedly screwed on the front portion of the cylinder 70. Prior to screwing of the front cover 84, a rear portion of a push-pull main rod 88 is closely fitted through the central opening 86 of the front cover 84 to allow a large diameter flange 89 locating within the hollow cylinder 70 when the cover 84 is screwed on the front end of the cylinder 70. When screwed, the small radial opening 71 of the cylinder 70 is coincided with the radial small opening 87, into which a compressed-air exhaust flexible pipe 78 is connected. The large diameter flange 89 of the push-pull main rod 88 is connected to the piston 80 within the cylinder 70.

A front portion of a hydraulic cylinder 90 which is laterally mounted on the rear post 68 is coupled to the rear end of the cylinder 70 by a ram 92, the rear end of which is connected to a hydraulic unit 96 by a pipe 94.

Figure 7:
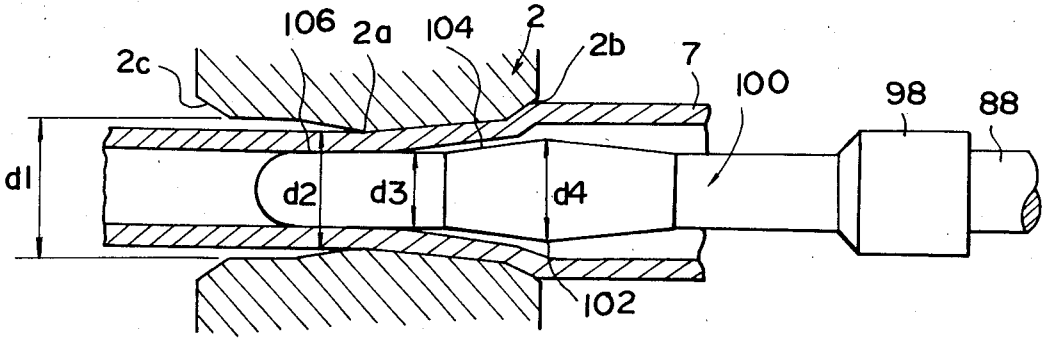
FIG. 7(*a*) is an enlarged vertical section of the reducing die, the mother tube and the plug of this invention, with its large diameter bearing of the plug approaching an inlet portion of the reducing die.
Figure 7:
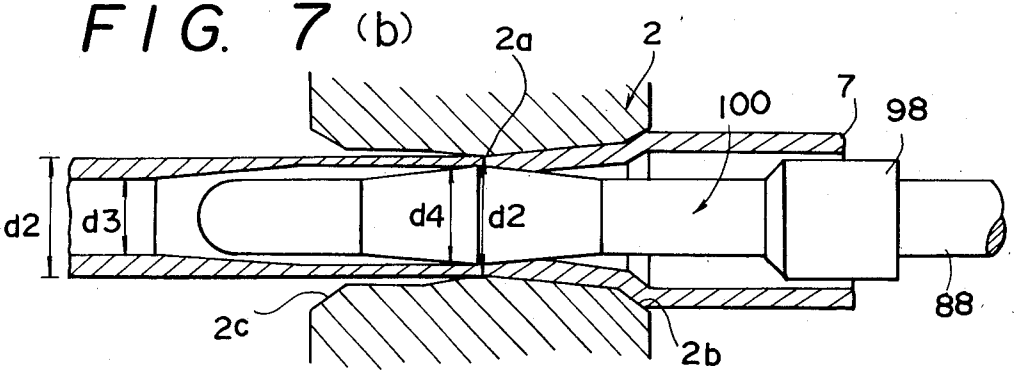
Figure 7:
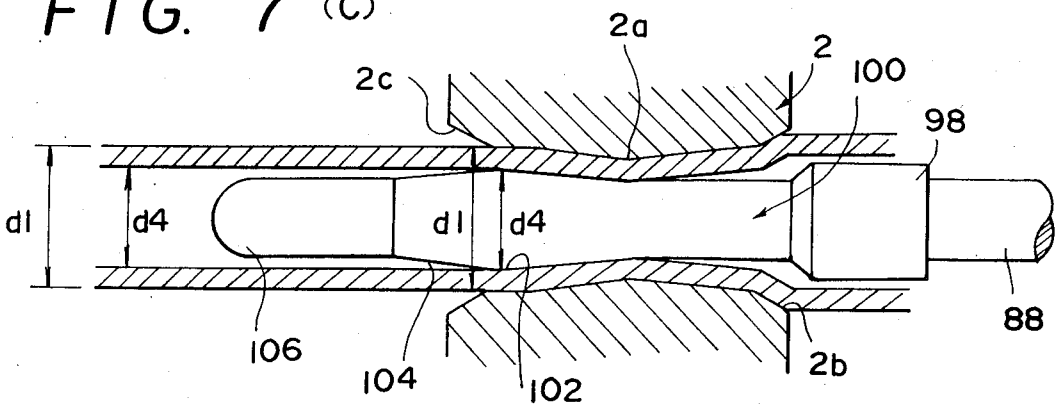

As shown in FIGS. 7(*a*)–7(*c*), a plug 100 is secured to a front end portion of the push-pull main rod 88 by a shank 98, and the plug 100 includes a large diameter bearing portion 102 ($d_4$), a forwardly tapered portion 104 and a small diameter bearing portion 106 ($d_3$) which are shaped forwardly in the stated order.

In accordance with the draw bench 10 of this invention, the left screw nut 74 is rotatably brought into contact with the front face 64*b* of the rear stopper 64 to determine the right fixed position, while the right screw nut 72 is rotatably brought into contact with the rear face 64*a* thereof to determine the left fixed position.

For drawing, the reducing die 2 and the plug 100 are respectively transferred to take the fixed positions by the hydraulic units 50 and 96 which are connected thereto by the respective pipes 48 and 94.

The reducing die 2 has an internal surface including an inlet portion 2*b* which tapers rearwardly, a small diameter bearing or throat portion 2*a* and an oppositely inclined outlet portion 2*c*.

A draw unit 110 is arranged on the exit side of the bed 12 and comprises a carriage 112 mounted on rollers travelling on the bed 12, the carriage 112 carrying a hook 118 and a chuck 114 for gripping the front tip 7*a* of the mother tube or workpiece 7. The carriage 112 is driven by an endless chain 120 encompassing a driven sprocket 122 and a driving sprocket wheel (not shown) mounted in the bed 12.

Drawing operations are schematically shown in FIGS. 7(*a*)–7(*c*). The die holder 26 is located at the left fixed position as shown in FIG. 5(*a*) to locate the large diameter bearing portion 102 ($d_4$) of the plug 100 at the rearwardly tapered inlet portion 2*b* as shown in FIG. 7(*a*), while the plug control device 60 is located at the right fixed position in FIG. 6 for drawing the mother tube 7.

In FIG. 7(*b*), the die holder 26 is located at the left fixed position and the plug fixing main rod 88 is also located at the left fixed position to fix the large diameter bearing portion 102 ($d_4$) of the plug 100 at the throat portion 2*a* of the reducing die 2, thus drawing the mother tube 7 having an inner peripheral upset portion 7*b* on each end.

Figure 8:
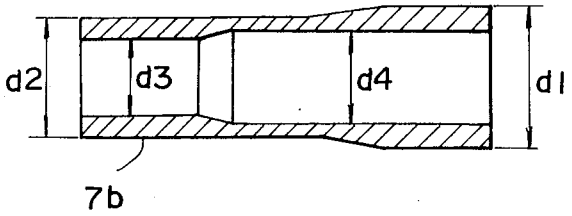
FIG. 8(*a*) is a cross-section of a seamless metal tube drawn through the draw bench of this invention, and having an inner upset portion on each end.
Figure 8:
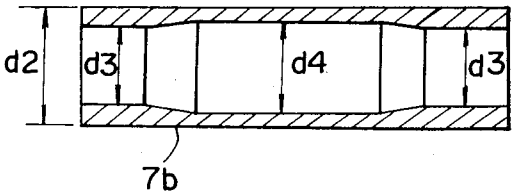
Figure 8:
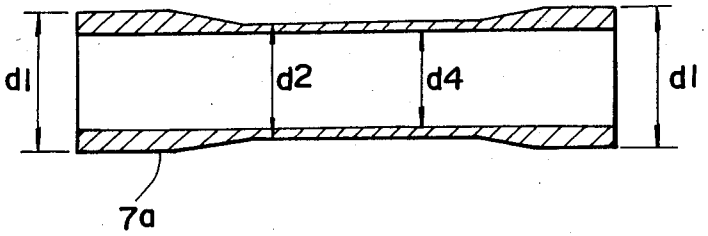
Figure 9:
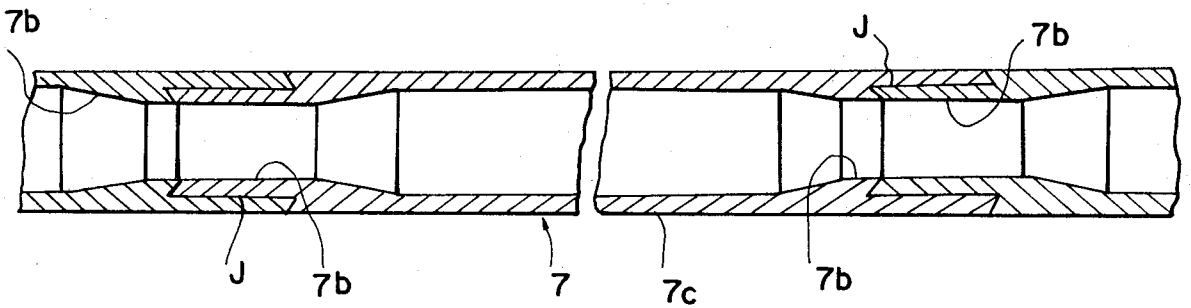
FIG. 9 is a cross section of the seamless metal tubes, partially cut away, which are threadedly screwed to join with each other at the upset portion on each ends.

The drawn tube 7 having an inner peripheral upset portion 7*b* on one end and an outer peripheral upset portion 7*b* on another end shown in FIG. 8(*b*) can be obtained through the continuous steps shown in FIGS. 7(*a*), 7(*b*) and 7(*c*). The drawn tube 7 having a inner peripheral upset portions 7*b* on both ends can be produced through the continuous steps shown in FIGS. 7(*a*), (*b*) and (*a*).

Finally, the drawn tube having outer peripheral upset portions 7*b* on both ends shown in FIG. 8(*c*) can be made by the steps shown in FIGS. 7(*c*), (*b*) and (*c*).

The die holder 26 and the plug fixing main rod 88 are driven to move with each other by means of the hydraulic units 50 and 96 which are mounted on the bed 12, taking account of the speeds among the drawn tube 7, the reducing die 2 and the plug 100.

After drawing, the plug 100 is again brought back to the starting position by the plug control device 60, while the die holder 26 is also returned to the starting position by the die control device 20.

An example of the drawn tube 7 having an upset portion 7*b* on both ends embodying the novel veature of this invention is given below.

| EXAMPLE | |
|---|---|
| material | Mn—Cr—Mo steel alloy |
| heat treatment | quenching and tempering finally resulted in martensitic structure |
| size after drawing | |
| outer diameter | 88.9 mm |
| thick wall thickness | 6.6 mm |
| thin wall thickness | 5.0 mm |
| length | 2–6 m |
| Shore hardness | 43 |
| strength | 90 Kg/mm$^2$ |
| joint of each trawn tube | joined at acme tapered screw thread of the upset end portion. |
| use | survey for underground resources such as uranium, metals etc. or for geological survey. |
| rotation | 800–1000 rpm |
| depth | boring into 1000–1500 m under the ground. |
| other benefit | mud and slurry are smoothly circulated. |

As is clear from the foregoing description and the Example, the novel draw bench in accordance with the present invention considerably improves the drawing steps, drawing rate, reduction of area and the like, and it is preferably directed to drawing seamless metal tubes having upset portions on both ends.

While an embodiment of this invention has been described, it is obvious that variations and modifications are possible without departing from the invention. It is desired to cover all such forms of the invention as would be apparent to one skilled in the art, and that come within the scope of the appended claims.

We claim:

1. A draw bench for drawing seamless metal tubes each having an upset portion on both ends which comprises:

a bed;

a front stopper mounted on a middle portion of said bed and reinforced by a reinforcing member;

a die control device, on said bed adjacent to said front stopper, said die control device comprising a rail longitudinally mounted on said bed and adjacent to said front stopper, a carriage longitudinally movably disposed on said rail, a die holder on said carriage and having a central large diameter opening, a cylindrical holder secured to a rear face of said die holder and including a closed periphery reducing die concentrically abutting upon said central large diameter opening of said die holder and having an internal surface, a pair of hydraulic cylinders on diametrically peripheral portions of said rear face of said die holder, a pair of rams respectively longitudinally connecting said hydraulic cylinders to a rear face of said front stopper, and a hydraulic unit connected to each hydraulic cylinder by a first pipe;

a plug control device on an entry side of said bed longitudinally rearward of said die control device and coaxial with said die control device, said plug control device including a base rigidly mounted on said bed, said base including a rear stopper having a lateral opening, and a rear post rearward of said rear stopper, a leading screw compressed-air cylinder having an outer cylindrical body having external threads, rotatably and slidably penetrating said lateral opening and including a piston longitudinally slidably fitted in an interior space thereof, a pair of screw nuts threadedly screwed on and screwably movable longitudinally on said leading screw compressed-air cylinder on longitudinally opposite sides of said rear stopper so as to restrict longitudinal movement of said compressed-air cylinder by contact therewith, a plug fixing push-pull main rod connected to a front end portion of said compressed-air cylinder, a compressed-air supply pipe connected to a rear portion of said compressed-air cylinder so as to communicate with said interior space rearward of said piston, a compressed-air exhaust pipe connected to a front portion of said compressed-air cylinder so as to communicate with said interior space forward of said piston, a hydraulic cylinder laterally mounted on said rear post and connected to said rear portion of said compressed-air cylinder, and a hydraulic means, connected by means of a hydraulic unit pipe to said hydraulic cylinder, for longitudinally moving said push-pull main rod, one of said hydraulic cylinder and said main rod being fixed to said piston, the other of said hydraulic cylinder and said main rod being fixed to said cylinder main body;

a plug secured to a front portion of said push-pull main rod so as to move longitudinally therewith adjacent said reducing die;

a draw unit for drawing a mother tube through said reducing die and around said plug, said draw unit including a carriage on an exit side of said bed forward of said front stopper, and a chuck with jaws for gripping the mother tube mounted on said carriage, said chuck being axially aligned with said reducing die, and said carriage being linked by a chain and a sprocket wheel with a geared reducer for longitudinal transfer of said chuck, whereby said reducing die and said plug are longitudinally movable with respect to each other between positions defined by the longitudinal positions of said screw nuts for diametrically changing a reducing area between said internal surface of said reducing die and said plug by fixing said reducing die and said plug at selected positions.

2. A draw bench as claimed in claim 1 wherein the internal surface of said closed periphery reducing die includes an inlet portion which tapers rearwardly and radially outwardly, a forwardly and radially outwardly tapered outlet portion and a first small diameter bearing portion between said inlet and outlet portions.

3. A draw bench as claimed in claim 2 wherein said plug is successively formed of a large diameter bearing portion of diameter less than the minimum internal diameter of said internal surface of said reducing die so that said plug is longitudinally movable to a position in which said large diameter bearing portion is radially aligned with said first small diameter bearing portion, a rearwardly and radially inwardly tapered portion and a second small diameter bearing portion of a diameter less than the diameter of said large diameter bearing portion located successively forwardly in the named order.

4. A draw bench as claimed in claim 1 wherein said plug is successively formed of a large diameter bearing portion of diameter less than the minimum internal diameter of said internal surface of said reducing die.

5. A draw bench as in claim 1, wherein said main rod is fixed to said piston and said hydraulic cylinder is fixed to said cylindrical body.

6. A draw bench for drawing seamless metal tubes having an upset portion on each end, comprising:

a longitudinally extending bed;

a front stopper mounted on a longitudinally middle portion of said bed;

a die control device on said bed adjacent said front stopper, said die control device including a die holder longitudinally movable on said bed, means for driving said die holder longitudinally on said bed, and a closed periphery reducing die having an internal surface, held by said die holder so that a mother tube can be drawn longitudinally therethrough within said internal surface;

a plug control device on an entry side of said bed longitudinally rearward of said die control device and coaxial with said die control device, said plug control device including a rear stopper having a lateral opening, mounted on said bed, a compressed air cylinder having an outer cylindrical body having external threads, rotatably and slidably penetrating said lateral opening and including a piston longitudinally slidably fitted in an interior space thereof, a pair of screw nuts longitudinally adjustably threadedly screwed on said compressed air cylinder on longitudinally opposite sides of said rear stopper so as to restrict longitudinal movement of said compressed air cylinder by contact therewith, a plug fixing push-pull main rod connected to said piston through a front end portion of said compressed air cylinder, a compressed air supply pipe connected to a rear portion of said compressed air cylinder so as to communicate with said interior space rearward of said piston, a compressed air exhaust pipe connected to front portion of said compressed air cylinder so as to communicate with said interior space forward of said piston, and means connected to said cylindrical body, for driving said compressed air cylinder and said main rod longitudinally;

a plug secured to a front portion of said main rod so as to move longitudinally therewith adjacent said reducing die, whereby said reducing die and said plug are longitudinally movable with respect to each other between positions defined by the longitudinal positions of said screw nuts, for diametrically changing a reducing area between said internal surface of said reducing die and said plug by fixing said reducing die and said plug at selected positions; and drawing means for drawing the mother tube through said reducing die and around said plug.

7. A draw bench as claimed in claim 6 wherein the internal surface of said closed periphery reducing die includes an inlet portion which tapers rearwardly and radially outwardly, a forwardly and radially outwardly tapered outlet portion and a first small diameter bearing portion between said inlet and outlet portions.

8. A draw bench as claimed in claim 7 wherein said plug is successively formed of a large diameter bearing portion of diameter less than the minimum internal diameter of said internal surface of said reducing die so that said plug is longitudinally movable to a position in which said large diameter bearing portion is radially aligned with said first small diameter bearing portion, a rearwardly and radially inwardly tapered portion and a second small diameter bearing portion of a diameter less than the diameter of such large diameter bearing portion located successively forwardly in the named order.

9. A draw bench as claimed in claim 6 wherein said plug is successively formed of a large diameter bearing portion of diameter less than the minimum internal diameter of said internal surface of said reducing die.

* * * * *